US012060205B2

(12) United States Patent
Lausted et al.

(10) Patent No.: US 12,060,205 B2
(45) Date of Patent: Aug. 13, 2024

(54) SPLASH GUARD FOR VENTED CONTAINERS

(71) Applicant: Ecolab USA Inc., Saint Paul, MN (US)

(72) Inventors: Matthew Darold Lausted, Hudson, WI (US); Joseph Steven Bons, Oakdale, MN (US); Andrew Richard Sarnstrom, Minneapolis, MN (US); Lisa Anne Kreye, Woodbury, MN (US); Karl Alan Heinbuch, Roberts, WI (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 16/723,900

(22) Filed: Dec. 20, 2019

(65) Prior Publication Data

US 2020/0198858 A1 Jun. 25, 2020

Related U.S. Application Data

(60) Provisional application No. 62/784,203, filed on Dec. 21, 2018.

(51) Int. Cl.
*B65D 51/16* (2006.01)
*B65D 85/84* (2006.01)

(52) U.S. Cl.
CPC ..... *B65D 51/1605* (2013.01); *B65D 85/84* (2013.01)

(58) Field of Classification Search
CPC .... B65D 51/1605; B65D 85/84; B65D 47/32; B65D 47/06; B65D 51/16; B65D 51/1616
See application file for complete search history.

(56) References Cited

U.S. PATENT DOCUMENTS 5,649,639 A * 7/1997 Dolvet ..... B65D 51/1644 220/203.11
2014/0226922 A1* 8/2014 Bons ..... B65D 75/5877 383/100
2016/0271638 A1 9/2016 Erlandson et al.

FOREIGN PATENT DOCUMENTS

WO 2020132598 6/2020

OTHER PUBLICATIONS

"International Application Serial No. PCT/US2019/068101, International Search Report mailed Apr. 15, 2020", 5 pgs.

(Continued)

*Primary Examiner* — Anthony D Stashick
*Assistant Examiner* — L Kmet
(74) *Attorney, Agent, or Firm* — Schwegman Lundberg & Woessner, P.A.

(57) ABSTRACT

The present disclosure provides a splash guard to minimize potential contact between the chemical product and a vent membrane during transport and/or transfer of containers, thereby resulting in preservation of the integrity of a vent membrane during transport and/or transfer of a chemical product. The splash guard is affixed to the fitment and so can be removed from the interior of the container prior to transfer of the chemical product out of the container. The splash guard may be used with fitments of varied shapes, sizes and/or structures, and with containers of varied shapes, sizes and/or structures. The splash guard is easy and inexpensive to manufacture and easy to install, e.g., by snapping onto a ring (lower perimeter) of a fitment. For example, the splash guard covers the entire circumference of the neck of a container, and is formed of a moldable material that provides rigidity.

14 Claims, 4 Drawing Sheets

(56) References Cited

OTHER PUBLICATIONS

"International Application Serial No. PCT/US2019/068101, Written Opinion mailed Apr. 15, 2020", 5 pgs.
"International Application Serial No. PCT US2019 068101, International Preliminary Report on Patentability mailed Jul. 1, 2021", 7 pages.
"European Application Serial No. 19842516.7, Response to Communication pursuant to Rules 161(1) and 162 EPC filed Feb. 3, 2022", 26 pages.
"European Application Serial No. 23181698.4, Communication pursuant to Rule 56(1) and Rule 56a(1) EPC mailed Jul. 7, 2023", 3 pgs.
"European Application Serial No. 23181698.4, Extended European Search Report mailed Dec. 8, 2023", 6 pgs.
"European Application Serial No. 23181698.4, Response Filed Aug. 14, 2023 to Communication pursuant to Rule 56(1) and Rule 56a(1) EPC mailed Jul. 7, 2023", 28 pgs.

* cited by examiner

SPLASH GUARD FOR VENTED CONTAINERS

CLAIM OF PRIORITY

This patent application claims the benefit of U.S. Provisional Patent Application No. 62/784,203, filed Dec. 21, 2018, entitled "SPLASHGUARD FOR VENTED CONTAINERS", which is incorporated by reference herein in its entirety.

TECHNICAL FIELD

The present disclosure relates generally to systems for storing liquid or slurried products, including but not limited to acids, detergents, wetting agents, drying agents and rinse aids used in industrial cleaning processes, or liquids used, for example, in the food or beverage industry, textile/laundry industry or mining industry. More particularly, but not exclusively, the present disclosure relates to protecting a vent membrane in a fitment connected to a chemical product container.

BACKGROUND

In many processes, specialized liquid chemical products are utilized. For instance, in many modern industrial cleaning processes, specialized liquid chemical products are utilized to improve cleaning efficiency and minimize water consumption. The containers storing the chemical product are often sealed and include a fitment disposed within an opening in the container. The fitment may be designed to create a friction fit with the container or otherwise be secured in the opening. The fitment typically includes a vent to permit air to enter the container as chemical product may be removed under negative pressure, thereby preventing container collapse, ensuring even fluid flow and chemical dilution, and otherwise maintaining a consistent pressure profile within the container.

In other instances, the containers store off-gassing chemicals that require ventilation. For example, peroxide-based cleaners are best stored and used from a container that includes a ventilation system. The vent is typically associated with a vent membrane to filter incoming air or escaping gas. A representative fitment with a vented insert and membrane is shown in U.S. Pub. No. 2013/0153592 to Bons et al., herein incorporated by reference in its entirety.

The chemical products are supplied to facilities in the containers. In many instances, the containers arrive with the fitments preinstalled. During transport, however, the containers are frequently jostled about, often causing the chemical product to come into contact with the vent membrane of the fitment. The contact or excessive contact of the chemical product with the vent membrane often causes the vent membrane to function improperly and/or fail completely.

SUMMARY

The disclosure provides a splash guard to minimize potential contact between the chemical product and a vent membrane during transport and/or transfer of containers, thereby resulting in preservation of the integrity of a vent membrane during transport and/or transfer of a chemical product. The splash guard is affixed to the fitment and so can be removed from the interior of the container prior to transfer of the chemical product out of the container. The splash guard may be used with fitments of varied shapes, sizes and/or structures, and with containers of varied shapes, sizes and/or structures. The splash guard is easy and inexpensive to manufacture and easy to install, e.g., by snapping onto a ring (lower perimeter) of a fitment. For example, the splash guard covers the entire circumference of the neck of the container, e.g., a 10 L or 20 L container, and is formed of a moldable material that provides rigidity.

In one embodiment, the splash guard, when present in a fitment in a container, does not protrude into the main chamber of the container.

In one embodiment, the upper surface of the splash guard is flat. In one embodiment, the lower surface of the splash guard is an inverted cone or pyramid shape. In one embodiment, the lower surface of the splash guard has a spoke pattern. In one embodiment, the spokes form an inverted cone shape.

The splash guard of this disclosure has improved properties, e.g., protects vent membranes more effectively than, for example, splash guards with flat lower surfaces.

These and/or other objects, features, and advantages of the present disclosure will be apparent to those skilled in the art. The present disclosure is not to be limited to or by these objects, features and advantages. No single embodiment need provide each and every object, feature, or advantage.

According to one embodiment, a system that protects a vent membrane from a liquid is provided. The system includes a container having an interior volume and an opening. A fitment is provided and seated in the opening of the container. The fitment may have a center opening and a perimeter. A vent and a vent membrane are associated with the fitment. One or more vents may be part of the fitment. A splash guard disposed within the interior volume of the container is provided. The splash guard comprises an upper surface opposite a lower surface. The upper surface may be proximate to the fitment. The upper surface may be flat or include a handle or other protrusion. The splash guard comprises an upper perimeter substantially contoured to the lower perimeter of the fitment. The splash guard prevents exposure of the vent membrane to the liquid.

According to one embodiment, the upper surface of the splash guard is flat and the lower surface is sloped downwardly from the perimeter. The splash guard may comprise a plurality of ridges associated with the lower surface and radially extending from near the center of the lower surface of the splash guard to the perimeter. In one of the embodiment, each of the plurality of ridges has a top surface and opposing side surfaces. According to one embodiment, the upper perimeter of the splash guard is less than lower perimeter of the splash guard when the splash guard is not in the neck of the container.

BRIEF DESCRIPTION OF THE DRAWINGS

Illustrated embodiments of the invention are described in detail below with reference to the attached drawing figures, which are incorporated by reference herein, and where:

FIG. 49 is a side view of a splash guard in accordance with an illustrative embodiment;

DETAILED DESCRIPTION

Figure 1:
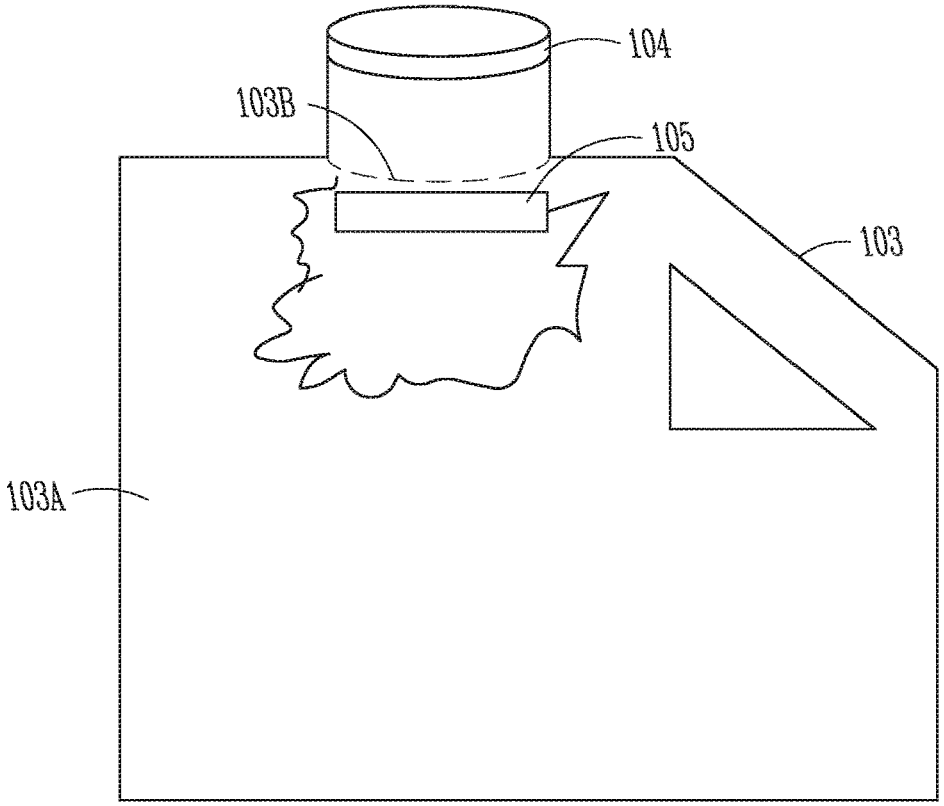
FIG. 1 is a front perspective view of a vented container system in accordance with an illustrative embodiment.
Figure 2:
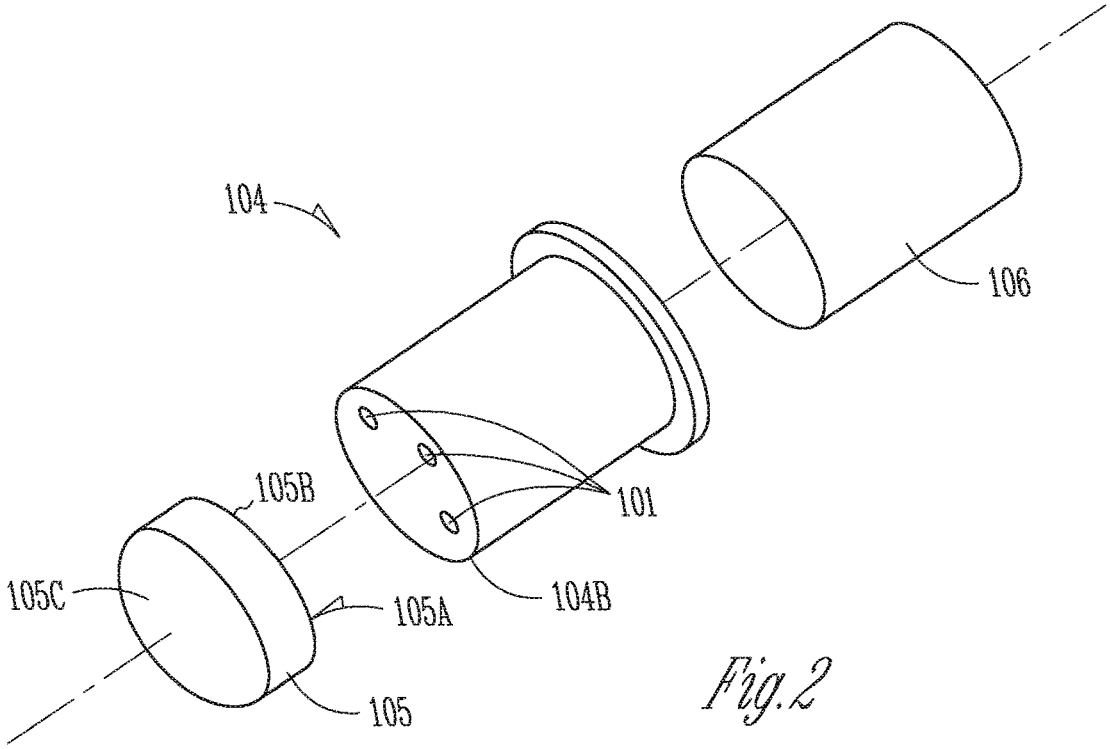
FIG. 2 is a side view of a vented container system in accordance with an illustrative embodiment.
Figure 3C:
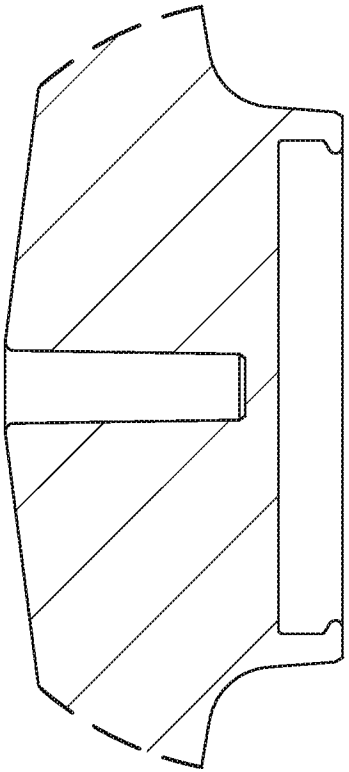
FIG. 3C is an angled view of a splash guard in accordance with an illustrative embodiment.
Figure 3B:
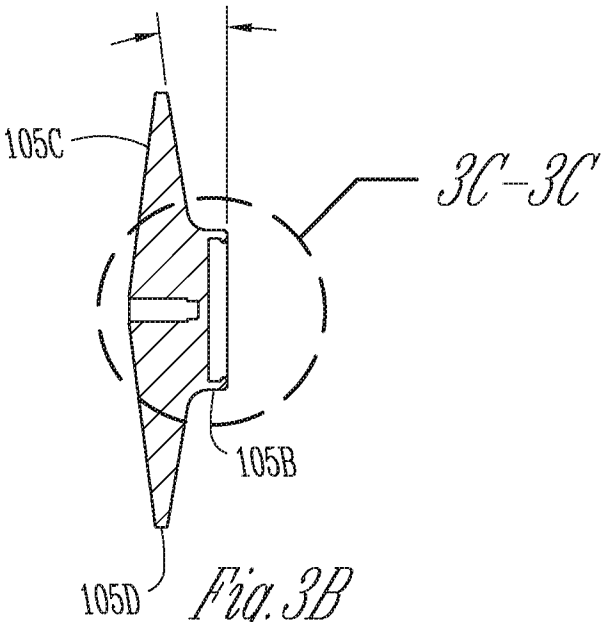
FIG. 3B is a side view of a splash guard in accordance with an illustrative embodiment.
Figure 3A:
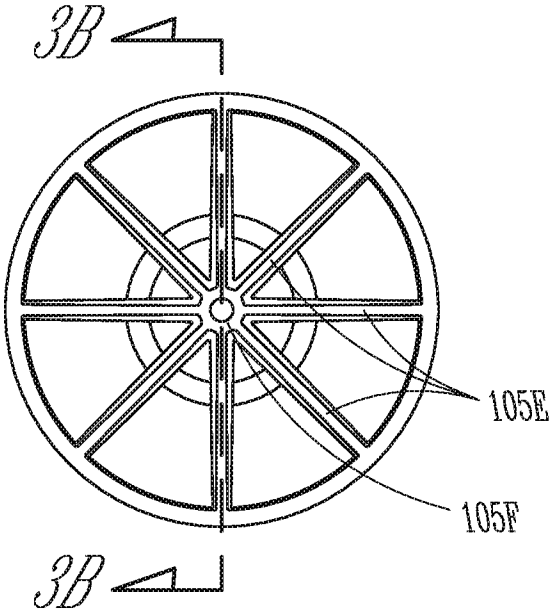
FIG. 3A is a bottom view of a splash guard in accordance with an illustrative embodiment.
Figures 4A, 4B, 4C:
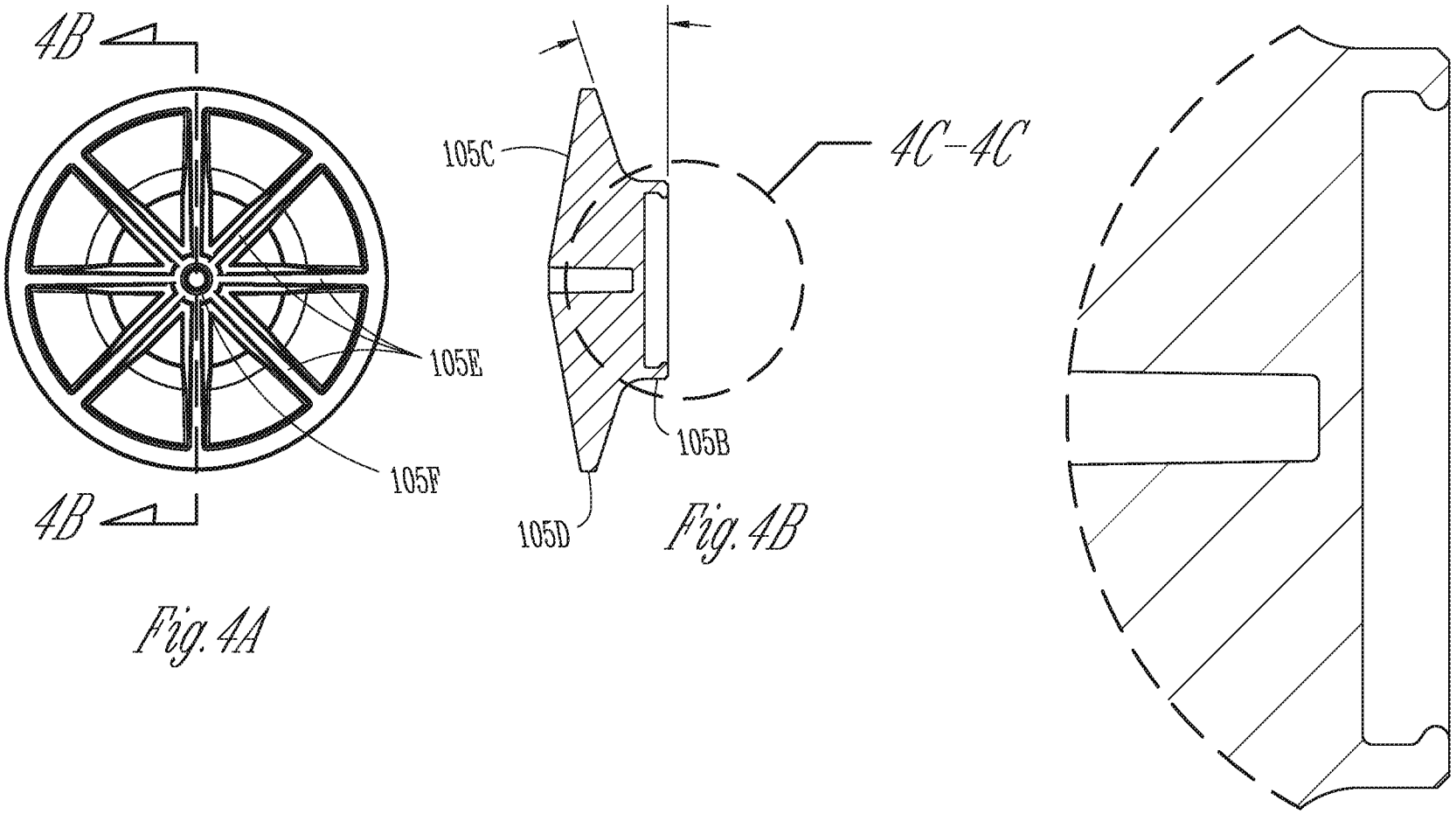
FIG. 4A is a bottom view of a splash guard in accordance with an illustrative embodiment.
FIG. 4C is an angled side view of a splash guard in accordance with an illustrative embodiment.
Figure 5:
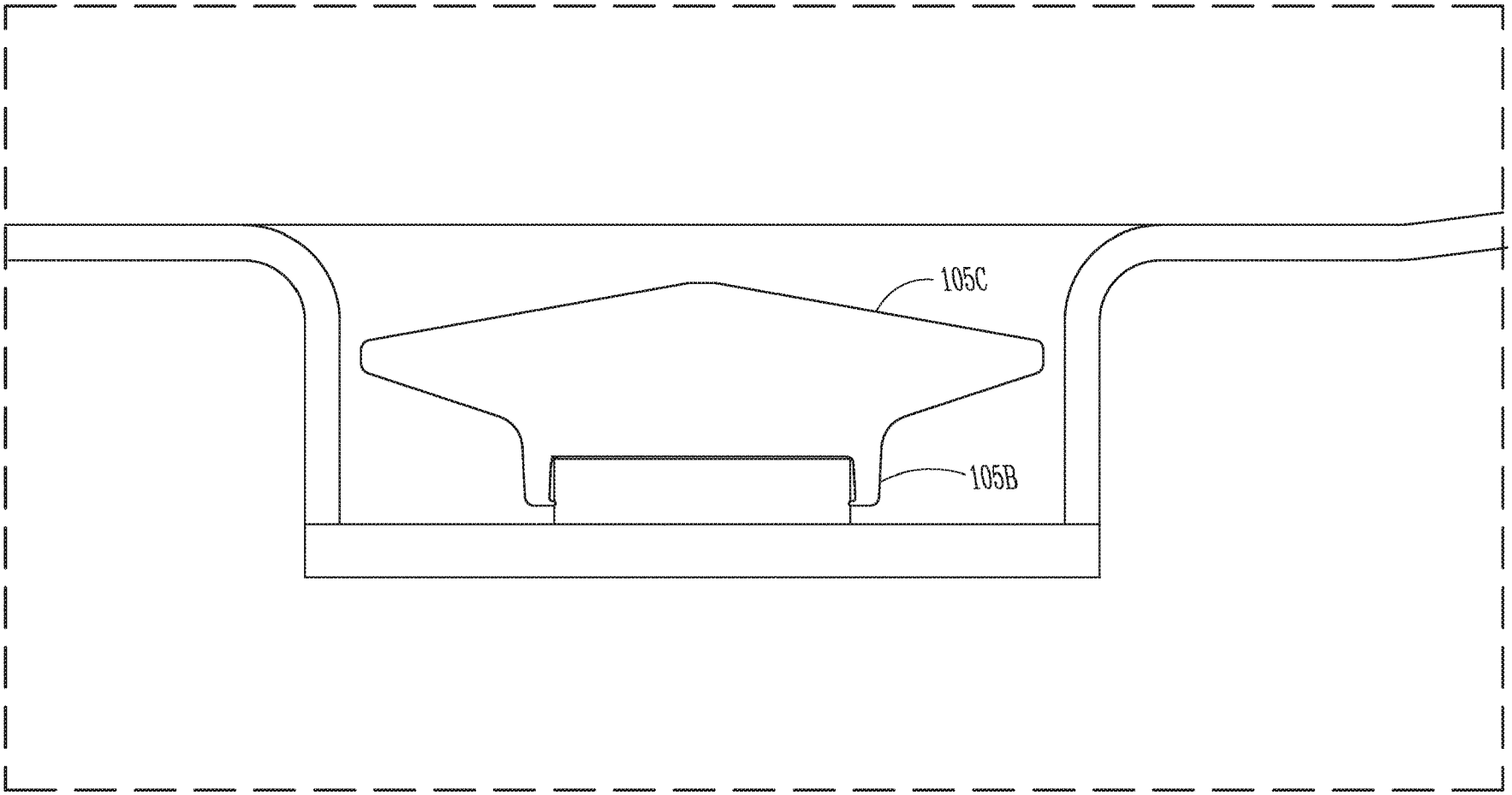
FIG. 5 is a side view of a splash guard in accordance with an illustrative embodiment.

FIG. 1 illustrates an exemplary assembly of a fitment 104, vent 101, vent membrane 106 and splash guard 105 for assembly with a container 103 having liquids often used in an industrial cleaning process. The container 103 includes an opening 103*b* and an interior volume 103*a* adapted to store a liquid 102. The container may be a rigid structure, but the present disclosure contemplates containers of varied structure and dimension. For example, the container 103 may be a flexible pouch capable of storing a liquid. Other exemplary containers may include bins, tubs, tubes, buckets, and the like. In addition to liquid chemical products, the present disclosure also envisions other material compositions that may adversely affect a vent membrane of a fitment, including but not limited slurries, powders, and granules.

Referring to FIG. 1, a fitment 104 is seated in an opening 103*b* of a container 103. The fitment 104 may have an outer surface on the lower perimeter 104*b* adapted to create a friction fit with the splash guard 105. The lower surface of the splash guard 105 may have a perimeter 105*d* that outwardly has a circumference slightly greater than the opening 103*b* of the container 103, to secure the splash guard 105 within the opening 103*b*. In one embodiment of the fitment 104, a cap (not shown) may be threadably or otherwise secured to the container 103 with the fitment 104 installed. The fitment 104 and splash guard 105 may be installed prior to transport of the container 103, e.g., prior to liquid is added. In one embodiment the opening 103*b* and the fitment 104 are generally disposed on the top of the container 103 but it should be appreciated that any number of fitments may be included generally anywhere on the container 103. Other configurations appreciated by those skilled in the art are also contemplated as part of the present disclosure.

The fitment 104 has a vent 101 configured to permit gasses to escape from the interior of the container 103, such as when the product stored therein is an off-gassing product. The vents 101 may comprise one or more orifices disposed about a center opening of the fitment 104, or otherwise compatible with the design and structure of the fitment 104. The venting may alternatively be based on the material properties of the fitment 104. The splash guard 105 may be secured to the fitment 104 via threading, friction fit, interference fit, counterpoising locking features, or any other connective means commonly known in the art.

A vent membrane 106 is associated with the fitment 104. The vent membrane 106 may be comprised of expanded polytetrafluoroethylene (ePTFE) to allow gasses to pass through the vents 101, while not allowing the liquid to pass through. Other gas-permeable, liquid-impermeable membranes may be used, including but not limited to those comprising PTFE, polypropylene or polyethylene. The vent membrane 106 may be toroidal and configured to be inserted into the fitment 104, or of any suitable shape and/or size. For example, the vent membrane 106 may be a film associated with the vents 101. The vent membrane 106 may be multilayered, either coaxially or linearly, of unitary construction, or varying cross section or thickness, or of any material and/or physical properties.

During shipment of the container 103 filled with liquid 102, the container 103 may be agitated for any number of reasons. Due to the composition of the vent membrane 106 and the chemical products often used in many different industries such as in cleaning processes, contact between the two reduces the effectiveness of the vent membrane 106. To minimize or preferably prevent contact of the liquid 102 with the vent membrane 106, a splash guard 105 is installed in a fitment 104 which is then installed in the container, or a splash guard 105 is installed in the opening 103*b* or the neck 103*c* of the container, and then the fitment 104 is installed on the splash guard 105. The splash guard 105 is secured to the lower perimeter 104*b* of the fitment 104. The splash guard 105 may be positioned on the fitment 104 such that a gap exists between the splash guard 105 and the fitment 104. Because of the shape of the splash guard 105, air or other gases will be able to exit the container 103 in configurations where the splash guard 105 is in contact with the fitment 104.

The geometry of the splash guard 105 may be manufactured as desired to accommodate product containers with differing dimensions and differing neck geometries. Further, the splash guard 105 may be manufactured through injection molding, but the present disclosure contemplates other manufacturing methods such as thermoforming, three-dimensional printing, pressure-formed plastic, low pressure molding, coinjection, spin casting, and the like. Still further, the splash guard 104 may be composed of plastic such as polyethylene terephthalate (PETE), high density polyethylene (HDPE), polyvinyl chloride (PVC), low density polyethylene (LDPE), and/or polypropylene (PP). The material is suitably rigid and does not adversely react with the chemical product 102 contained within the container 103. The shape of the splash guard 105, together with the manufacturing and materials options, advantageously provides for an inexpensive device that is easy to manufacture.

Referring to FIGS. 3A, 3B, and 3C and FIGS. 4A, 4B and 4C, an embodiment of a splash guard 105 is illustrated. The splash guard 105 has an upper perimeter 105*b* generally contoured to the lower perimeter 104*b* of the fitment 104. In an embodiment, the perimeter 105*b* and 104*b* are circular. The splash guard 105 includes an upper surface 105*a* and a lower surface 105*c*. The upper surface 105*a* may be substantially planar, concave or convex, and the lower surface 105*c* may be sloped from the perimeter 105*d* to an apex, e.g., an upside down cone or pyramid. The upper surface 105*a* may be substantially planar, concave or convex, and the lower surface 105*b* may have a plurality of ridges 105*e* radiating from a ring at the center of the lower surface 105*b* outwards towards the perimeter 105*d*, which top of the ridges may slope towards the perimeter 105*d*. When installed, the upper surface 105*a* is proximate to the fitment 104.

The splash guard 105 may include a plurality of ridges 105*e* extending downwardly from the lower surface 105*b*. The ridges 105*e* may be disposed radially from the center 105*f*, which may take the shape of a ring. The ridges 105*e* may be any suitable shape. For example, the ridges 105*e* may have a top surface and two opposing surfaces.

The disclosure describes the embodiments of the invention in the context of chemical products such as those for cleaning processes. However, the splash guard may be applied across varied industries. For example, the splash guard may be incorporated into water care technology, such as water bottles with a vent and vent membrane (e.g., means for water purification). Further, the splash guard may be incorporated into pest elimination products, particularly those requiring vented containers to store hazardous chemicals. Still further, the splash guard may be incorporated into vented containers often used in the textile and/or laundry industries. Still yet further, the splash guard may be incorporated into the health care industry, as medical devices and/or containers used therein often require aspiration of a fluid.

The invention is not to be limited to the particular embodiments described herein. In particular, the invention contemplates numerous variations in the type of ways in which embodiments of the invention can be applied to protect a vent membrane in a fitment connected to a liquid product container during transport. The foregoing description has been presented for purposes of illustration and description. It is not intended to be an exhaustive list or limit any of the invention to the precise forms disclosed. It is contemplated that other alternatives or exemplary aspects that are considered included in the invention. The description is merely examples of embodiments, processes or methods of the invention. It is understood that any other modifications, substitutions, and/or additions can be made, which are within the intended spirit and scope of the invention.

What is claimed is:

1. A splash guard for protecting a vent membrane associated with a fitment from a liquid in a container having an interior volume, the splash guard comprising:

an upper surface having an upper perimeter substantially contoured to a lower perimeter of the fitment; and a lower surface having a perimeter and configured to prevent liquid from splashing on the vent membrane, wherein the lower surface comprises a ring comprising a plurality of ridges radially extending outwards from the ring towards the perimeter of the lower surface, wherein the splash guard when installed on the fitment allows for venting of gas while preventing liquid from contacting the vent membrane.

2. The splash guard of claim 1 wherein the splash guard comprises polyethylene.

3. The splash guard of claim 1 wherein the fitment is adapted to seat in an opening of the container.

4. The splash guard of claim 1 which is adapted to seat in a neck of the container.

5. A system for protecting a vent membrane from a liquid in a container having an interior volume, the system comprising:

a container having an interior volume and an opening;

a fitment adapted to seat in the opening of the container, the fitment having an upper perimeter and a lower perimeter;

a vent and the vent membrane which are associated with the fitment; and a splash guard disposed within the container, the splash guard associated with the lower perimeter of the fitment and allowing venting of the interior volume of the container while preventing liquid from contacting the vent membrane;

said splash guard comprising: an upper surface having a perimeter substantially contoured to a lower perimeter of the fitment; and a lower surface having a perimeter and configured to prevent liquid from splashing on the vent membrane, wherein the lower surface comprises a ring comprising a plurality of ridges radially extending outwards from the ring towards the perimeter of the lower surface, wherein the splash guard when installed on the fitment allows for venting of gas while preventing liquid from contacting the vent membrane; or an upper surface having a first perimeter substantially contoured to a lower perimeter of the fitment and having a second perimeter distal to the lower perimeter of the fitment that is greater in diameter than the first perimeter; and a lower surface configured to prevent liquid from splashing on the vent membrane, wherein the lower surface comprises is shaped as an inverted cone or pyramid shape, wherein the splash guard when installed on the fitment allows for venting of gas while preventing liquid from contacting the vent membrane.

6. The system of claim 5 wherein the splash guard comprises polyethylene.

7. The system of claim 5 wherein the perimeter of the splash guard is greater than the lower perimeter of the fitment.

8. The system of claim 5 wherein the perimeter of the splash guard creates a friction fit to the lower perimeter of the fitment.

9. The system of claim 5 wherein the container comprises a neck.

10. The system of claim 9 wherein the splash guard is disposed within the neck.

11. The system of claim 5 which comprises a liquid in the interior volume.

12. The system of claim 11 wherein the liquid comprises an acid.

13. A method for protecting a vent membrane from a liquid, comprising providing a fitment adapted to seat in an opening of a container, and installing a splash guard on an outer circumference of a lower perimeter of the fitment, said splash guard comprising:

an upper surface having a perimeter substantially contoured to a lower perimeter of the fitment; and a lower surface having a perimeter and configured to prevent liquid from splashing on the vent membrane, wherein the lower surface comprises a ring comprising a plurality of ridges radially extending outwards from the ring towards the perimeter of the lower surface, wherein the splash guard when installed on the fitment allows for venting of gas while preventing liquid from contacting the vent membrane; or an upper surface having a first perimeter substantially contoured to a lower perimeter of the fitment and having a second perimeter distal to the lower perimeter of the fitment that is greater in diameter than the first perimeter; and a lower surface configured to prevent liquid from splashing on the vent membrane, wherein the lower surface comprises is shaped as an inverted cone or pyramid shape, wherein the splash guard when installed on the fitment allows for venting of gas while preventing liquid from contacting the vent membrane.

14. A splash guard for protecting a vent membrane associated with a fitment from a liquid in a container having an interior volume, the splash guard comprising:

an upper surface having a first perimeter substantially contoured to a lower perimeter of the fitment and having a second perimeter distal to the lower perimeter of the fitment that is greater in diameter than the first perimeter; and a lower surface configured to prevent liquid from splashing on the vent membrane, wherein the lower surface is shaped as an inverted cone or pyramid shape, wherein the splash guard when installed on the fitment allows for venting of gas while preventing liquid from contacting the vent membrane.

* * * * *